US006213736B1

(12) United States Patent
Weisser

(10) Patent No.: US 6,213,736 B1
(45) Date of Patent: Apr. 10, 2001

(54) ELECTRIC MOTOR PUMP WITH MAGNETIC COUPLING AND THRUST BALANCING MEANS

(76) Inventor: G Louis Weisser, 6155 Plumas St. 223, Reno, NV (US) 89503

( * ) Notice: Subject to any disclaimer, the term of this patent is extended or adjusted under 35 U.S.C. 154(b) by 0 days.

(21) Appl. No.: 09/200,409

(22) Filed: Nov. 28, 1998

(51) Int. Cl.[7] ..... F04B 17/00
(52) U.S. Cl. ..... 417/420; 417/410.1; 417/423.12
(58) Field of Search ..... 417/420, 410.1, 417/422, 423.11, 423.12, 423.4, 423.6

(56) References Cited

U.S. PATENT DOCUMENTS

| | | | | |
|---|---|---|---|---|
| 2,969,741 | * | 1/1961 | Wright et al. | 417/420 |
| 2,996,994 | * | 8/1961 | Wright | 417/420 |
| 3,074,347 | * | 1/1963 | Clymer | 417/420 |
| 4,435,132 | * | 3/1984 | Haesloop et al. | 417/360 |
| 4,752,194 | * | 6/1988 | Weinen et al. | 417/420 |
| 4,998,863 | * | 3/1991 | Klaus | 417/63 |
| 5,165,872 | * | 11/1992 | Fleischmann et al. | 417/423.4 |
| 5,297,940 | * | 3/1994 | Buse | 417/63 |
| 5,501,583 | * | 3/1996 | Nagoaka et al. | 417/423.4 |

* cited by examiner

*Primary Examiner*—Teresa Walberg
*Assistant Examiner*—Thor Campbell
(74) *Attorney, Agent, or Firm*—Thomas J. Tighe

(57) ABSTRACT

An electric motor pump for corrosive, electric conductive, cryogenic and/or hazardous liquids which is submerged in the liquid, comprising a centrifugal pump in a pump housing and an electric motor in a separate motor housing, transmitting the power through a magnetic coupling, whereby a thrust equalizing device is mounted on the rotating pump shaft.

Figure 1:
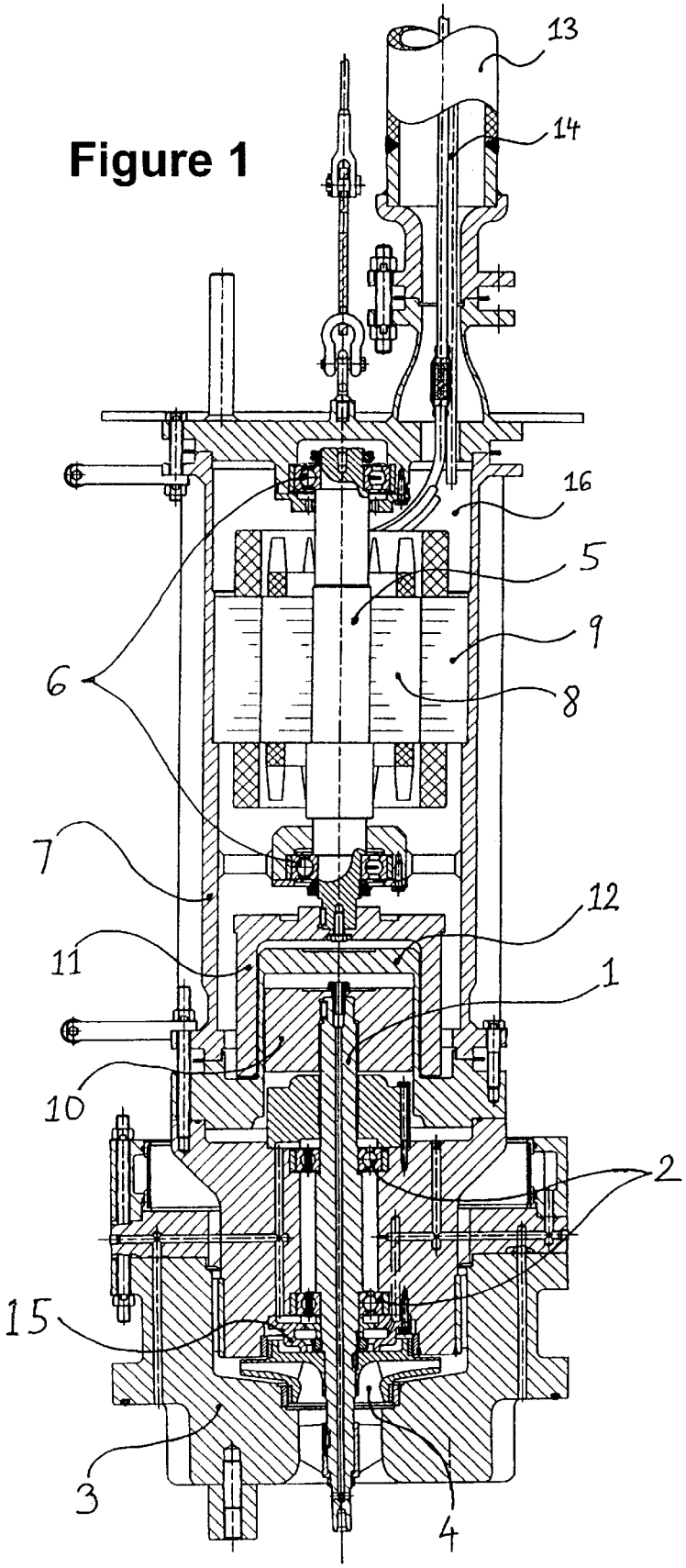

The motor housing is connected to a tubular device and the power cable is inside the tubular device and on one end connected to the electric motor stator and on the other end to the electric power grid. The motor housing and the tubular device contain an inert fluid under higher pressure than the surrounding liquid.

The electric motor pump is able to operate as a reverse running pump in the turbine mode, whereby the electric motor is an induction motor operating as an induction generator.

3 Claims, 1 Drawing Sheet

ELECTRIC MOTOR PUMP WITH MAGNETIC COUPLING AND THRUST BALANCING MEANS

FIELD OF INVENTION

This invention relates to an electric motor pump for corrosive, electric conductive, cryogenic and/or hazardous liquids which is submerged in the liquid.

BACKGROUND OF INVENTION

Submerged electric motor pumps for corrosive, electric conductive, cryogenic and/or hazardous liquids have a high rate of failure, because small leaks and cracks between the electric windings of the stator and the liquid cause chemical or physical disintegration of the electric motor. The bearings of the centrifugal pump have a high rate of failure, due to the above listed agressive liquids and the high centrifugal pump thrust.

The objective of the invention is to generate a submerged electric motor pump with the ability to operate in corrosive, electric conductive, cryogenic and/or hazardous liquids with a low rate of failure.

SUMMARY OF THE INVENTION

The proposed inventive solution suggests a centrifugal pump in a pump housing and an electric motor in a separate motor housing, and the power is transmitted through a magnetic coupling, whereby a thrust equalizing device is mounted on the rotating pump shaft.

The motor housing is connected to a tubular device and the power cable is inside the tubular device and on one end connected to the electric motor stator and on the other end to the electric power grid.

The motor housing and the tubular device contain an inert fluid like nitrogen or helium gas under higher pressure than the surrounding liquid.

BRIEF DESCRIPTION OF THE DRAWING FIGURE

The present invention will become more fully understood from the following detailed description, taken in conjunction with the accompanying drawing, wherein like reference numerals refer to like parts, in which:

FIG. 1 is a cross section of the electric motor pump with magnetic coupling and thrust balancing means.

In a further preferred embodiment the electric motor pump is operating as a reverse running pump in the turbine mode and the electric motor is an induction motor operating as an induction generator rotating with over synchronous rotational speed thus generating electric power.

The thrust equalizing device 15 increases the life time of the bearings 2 of the rotating pump shaft 1.

The magnetic coupling with two matching rotating parts 10 and 11, separated through the non-rotating cup 12, transmits the shaft power between the motor or the generator and the pump or the reverse running pump in turbine mode and separates mechanically the pump from the motor in such a way that the pumped liquid cannot penetrate into the motor housing 7.

The inert fluid 16 under higher pressure than the surrounding pumped liquid prevents the penetration of the pumped liquid into the motor housing in the case of leaks and cracks and prevents the chemical or physical disintegration of the electric motor.

The inventive solution is to provide an electric motor pump driven by a magnetic coupling with a thrust equalizing device and an inert fluid inside the motor housing under higher pressure than the surrounding pumped liquid.

DESCRIPTION OF THE PREFERRED EMBODIMENT

Referring to FIG. 1 which shows the cross section of the electric motor pump, whereby the rotating pump shaft 1 mounted in two bearings 2 in the pump housing 3 is mounted with one or more centrifugal pump impellers 4 and with one rotating part 10 of the magnetic coupling. The non rotating cup 12 of the magnetic coupling is mounted to the motor housing 7.

The rotating motor shaft 5 mounted in two bearings 6 in the motor housing 7 is mounted with the electric motor rotor 8 and with one rotating part 11 of the magnetic coupling matching the rotating part 10, and separated from each other through the non rotating cup 12.

The tubular device 13 is flexible for the preferred embodiment and mounted to the motor housing 7. The power cable 14 is inside the tubular device 13 and on one end connected to the electric motor stator 9 and on the other end to the electric power grid.

A thrust equalizing device 15 as it is prior art for centrifugal pumps and described in several publications is mounted on the rotating pump shaft 1.

The motor housing 7 and the tubular device 13 contain an inert fluid 16, which is for the preferred embodiment nitrogen, helium or argon gas, under higher pressure than the surrounding pumped liquid.

What is claimed is:

1. An electric motor pump for corrosive, electric conductive, cryogenic and/or hazardous liquids which is submerged in the liquid, comprising:

(a) a rotating pump shaft mounted in two bearings in a pump housing with one or more centrifugal pump impellers;

(b) a rotating motor shaft mounted in two bearings in a motor housing with an electric motor rotor;

(c) an electric motor stator mounted in said motor housing;

(d) a magnetic coupling with two matching rotating parts, one rotating part mounted on said pump shaft and one rotating part mounted on said motor shaft next to each other and separated by a non-rotating cup mounted to said motor housing;

(e) a tubular device connected to said motor housing;

(f) a power cable inside said tubular device connected to the electric motor stator;

whereby said motor shaft with said mounted electric motor rotor, with said mounted rotating part of said magnetic coupling, with said two bearings, and said electric motor stator are completely contained within said motor housing and separated from the pumped liquid, and a thrust equalizing device is mounted on said rotating pump shaft.

2. The electric motor pump of claim 1, wherein said motor housing and tubular device contain an inert fluid under higher pressure than the surrounding pumped liquid.

3. The electric motor pump of claim 2, wherein said electric motor pump is operating as a reverse running pump in the turbine mode and said electric motor is an induction motor operating as an induction generator rotating with over synchronous rotational speed.

* * * * *